US006045430A

United States Patent [19]

How

[11] Patent Number: 6,045,430

[45] Date of Patent: Apr. 4, 2000

[54] TOY FLOWERPOT WITH MOVABLE TOY FLOWERS

[76] Inventor: Chin-Jung How, 58, Ma Yuan West St., Taichung, Taiwan

[21] Appl. No.: 09/251,874

[22] Filed: Feb. 17, 1999

[51] Int. Cl.[7] ..... A63H 33/30; A63H 33/26

[52] U.S. Cl. ..... 446/236; 40/414

[58] Field of Search ..... 40/414; 446/236, 446/484

[56] References Cited

U.S. PATENT DOCUMENTS

| | | | |
|---|---|---|---|
| 3,100,365 | 8/1963 | Stalder | 446/236 |
| 4,983,890 | 1/1991 | Satoh et al. | 446/236 X |
| 5,056,249 | 10/1991 | Sakurai | 40/414 |
| 5,090,936 | 2/1992 | Satoh et al. | 40/414 X |
| 5,617,658 | 4/1997 | Chen | 446/236 X |
| 5,666,750 | 9/1997 | Segan et al. | 446/236 X |
| 5,706,596 | 1/1998 | How | 40/414 |

*Primary Examiner*—John A. Ricci

[57] ABSTRACT

A toy flowerpot with movable toy flowers includes a pot defining a space in which a battery-powered transmission mechanism and more than one rotating mechanism are provided to rotate, elevate, and lower toy flowers connected to and located above the rotating mechanisms. The rotating mechanism each includes a rotational shaft connected to a central shaft of an actuating gear that is brought to rotate by gears included in the transmission mechanism and meshing with one another. An elevating cylinder is associated with and therefore rotates along with the rotational shaft. A wheel is connected to a lever horizontally extended from the elevating cylinder and rotatably moves along an inclined top surface of a hollow cylinder surrounding the elevating cylinder when the elevating cylinder rotates, and thereby brings the elevating cylinder to move up and down while rotating. The toy flowers connected to a top of the elevating cylinder are therefore elevated and lowered while rotating along with the elevating cylinder.

2 Claims, 5 Drawing Sheets

C'-C'

C-C

TOY FLOWERPOT WITH MOVABLE TOY FLOWERS

BACKGROUND OF THE INVENTION

The present invention relates to a toy flowerpot, and more particularly to a toy flowerpot having toy flowers that interestingly move up and down while they rotate and swing in the toy flowerpot.

A conventional toy flowerpot available in the market has toy flowers that can only rotate in monotonous movement and therefore fails to attract consumers. It is desirable to develop an improved toy flowerpot with flowers that move up and down while rotating and swinging and therefore make the toy flowerpot more interesting and attractive.

SUMMARY OF THE INVENTION

A primary object of the present invention is to provide a toy flowerpot with movable toy flowers that includes a pot defining a space in which a battery-powered transmission mechanism and more than one rotating mechanism are provided to rotate, elevate, and lower toy flowers connected to and located above the rotating mechanisms. The rotating mechanism each includes a rotational shaft connected to a central shaft of an actuating gear that is brought to rotate by gears included in the transmission mechanism and meshing with one another. An elevating cylinder is associated with and therefore rotates along with the rotational shaft. A wheel is connected to a lever horizontally extended from the elevating cylinder and rotatably moves along an inclined top surface of a hollow cylinder surrounding the elevating cylinder when the elevating cylinder rotates, and thereby brings the elevating cylinder to move up and down while rotating. The toy flowers connected to a top of the elevating cylinder are therefore elevated and lowered while rotating along with the elevating cylinder.

BRIEF DESCRIPTION OF THE DRAWINGS

The structural features of the present invention can be best understood by referring to the following detailed description of the preferred embodiments and the accompanying drawings, wherein.

DETAILED DESCRIPTION OF THE PREFERRED EMBODIMENTS

Figure 1:
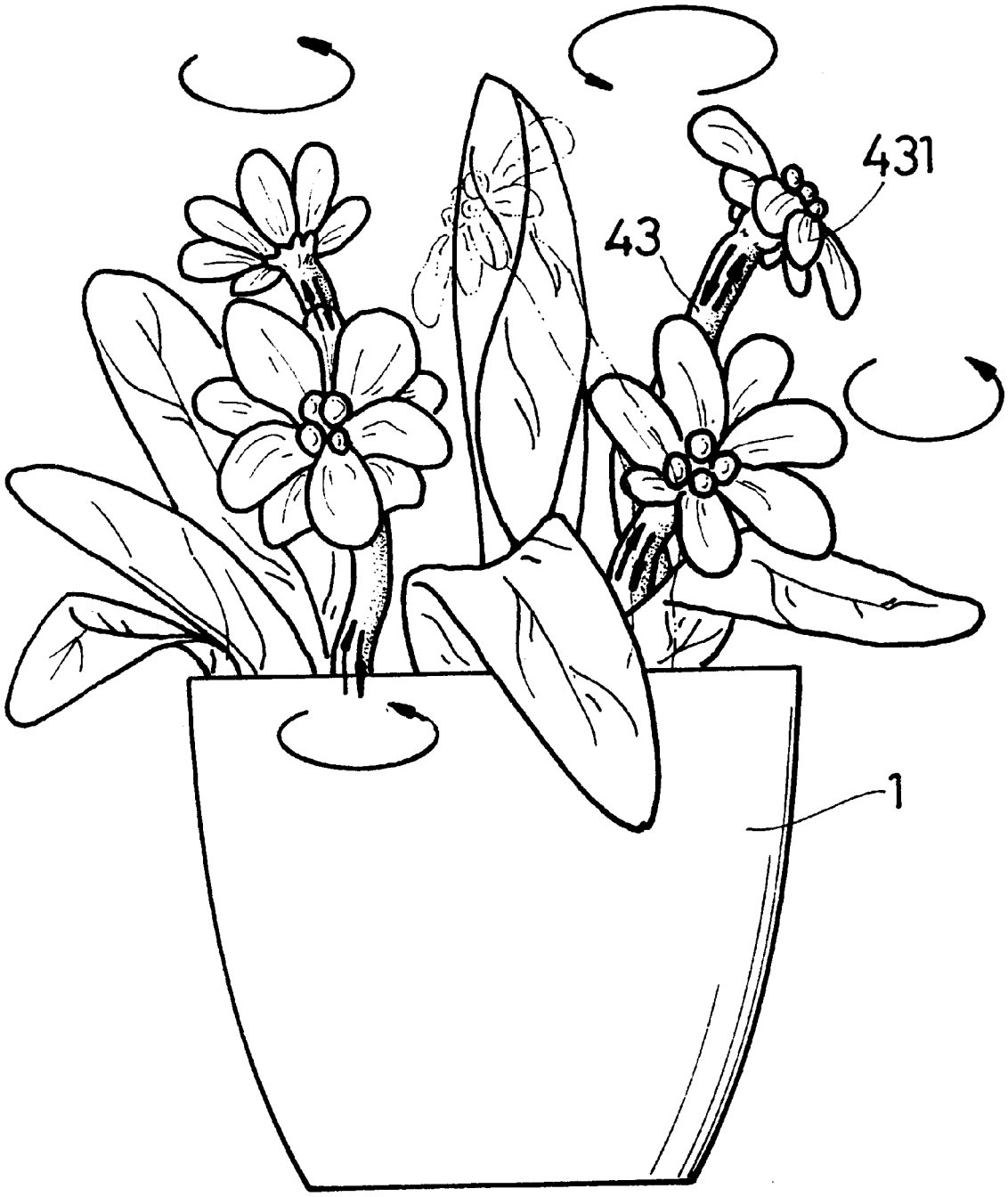
FIG. 1 illustrates how the toy flowers in the toy flowerpot of the present invention rotate and move up and down.
Figure 2:
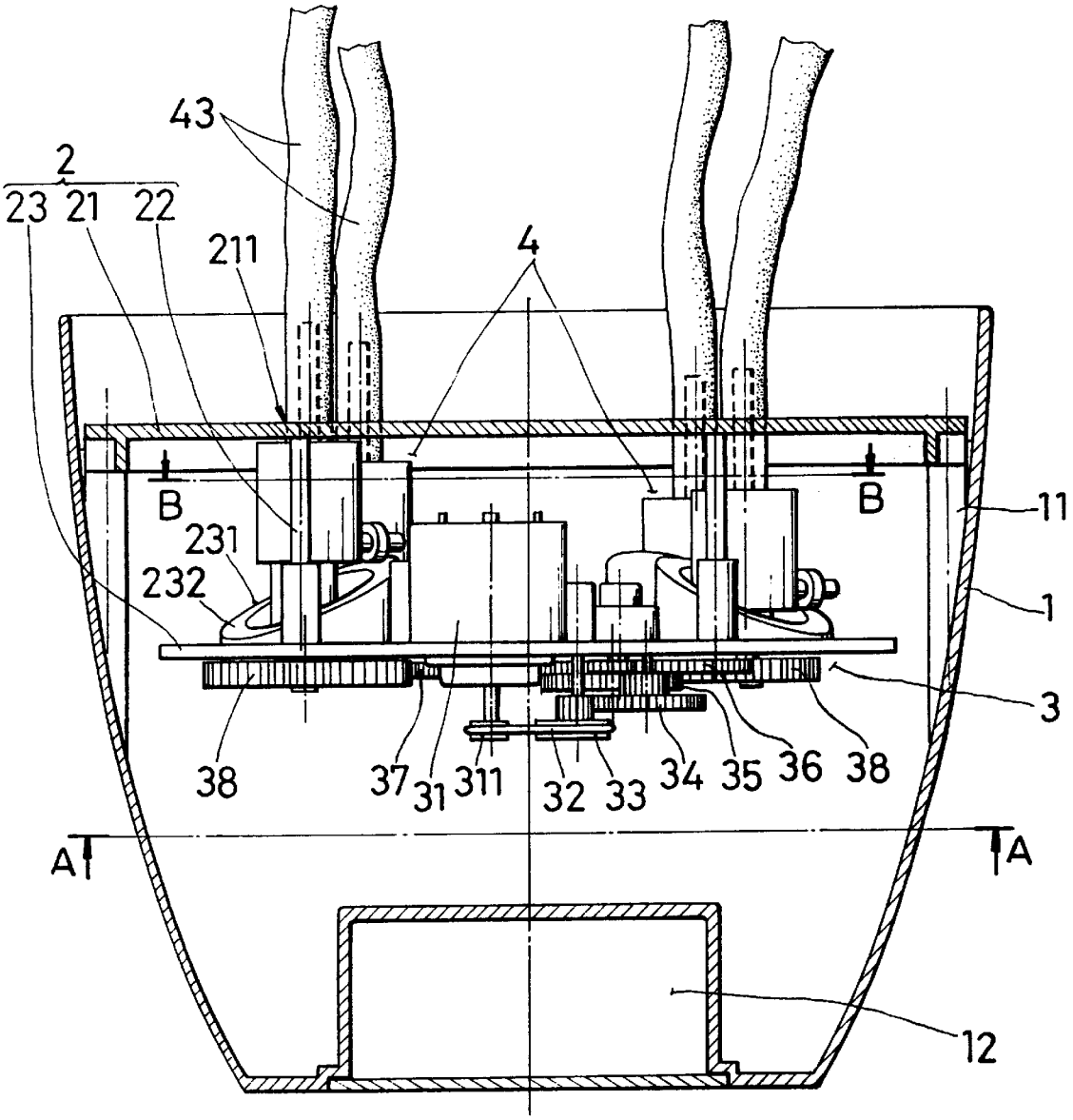
FIG. 2 is a fragmentary and enlarged vertical sectional view showing an internal structure of the toy flowerpot of FIG. 1.

Please refer to FIGS. 1 and 2 that are perspective view and fragmentary and enlarged vertical sectional view, respectively, of a toy flowerpot according to an embodiment of the present invention. As shown, the toy flowerpot mainly includes a pot 1, a fixing framework 2, a transmission mechanism 3, and more than one rotating mechanism 4.

The pot 1 has an upper opening wider than a bottom thereof and defines a hollow space therein for accommodation of the fixing framework 2, the transmission mechanism 3, and the more than one rotating mechanism 4 therein. A plurality of equally spaced supporting ribs 11 are formed on an inner wall surface of the pot 1 to upwardly extend from suitable lower points to suitable higher points. A battery compartment 12 is formed at a bottom of the pot 1 for accommodating batteries (not shown) that supply power required by the transmission mechanism 3.

The fixing framework 2 mainly includes a horizontal top cover 21 that is supported on the supporting ribs 11, a plurality of connecting rods 22 vertically downward extended from a bottom surface of the top cover 21, and a gear mounting board 23 that is connected to lower ends of the connecting rods 22 to locate below and in parallel with the top cover 21. The top cover 21 is provided at proper positions with more than one through hole 211 that each has a toy flower stem 43 extended therethrough. The gear mounting board 23 is provided on a top surface with more than one hollow cylinder 231 corresponding to the more than one through hole 211 on the top cover 21. Each of the hollow cylinders 231 has a top end that defines an inclined and annular top surface 232.

Figure 3:
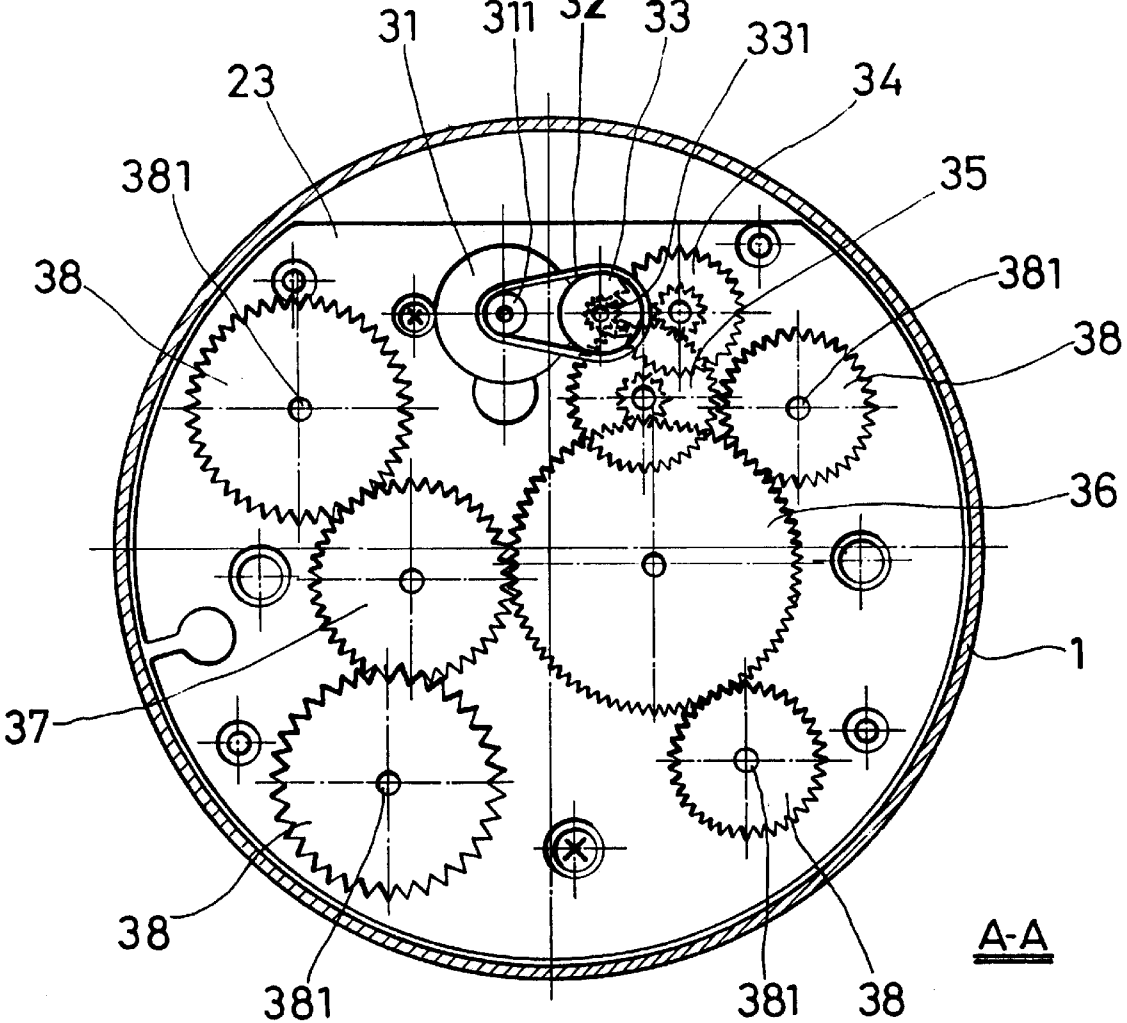
FIG. 3 is a cross sectional view taken on line A—A of FIG. 2 showing the arrangement of wheels and gears included in the transmission mechanism of the toy flowerpot of FIG. 1.
Figure 4:
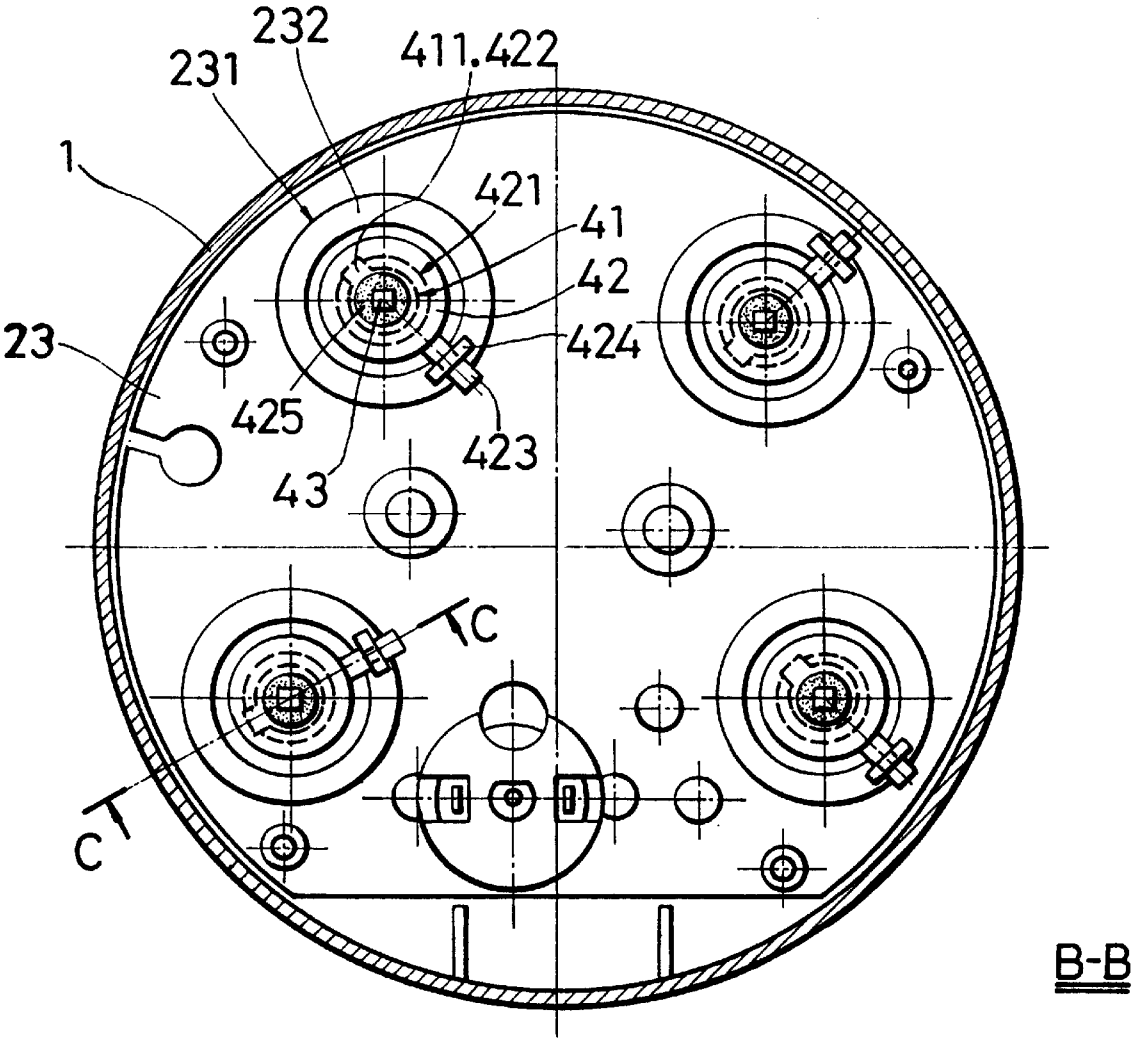
FIG. 4 is a cross sectional view taken on line B—B of FIG. 2 showing the arrangement of components included in the rotating mechanisms of the toy flowerpot of FIG. 1.
Figure 6:
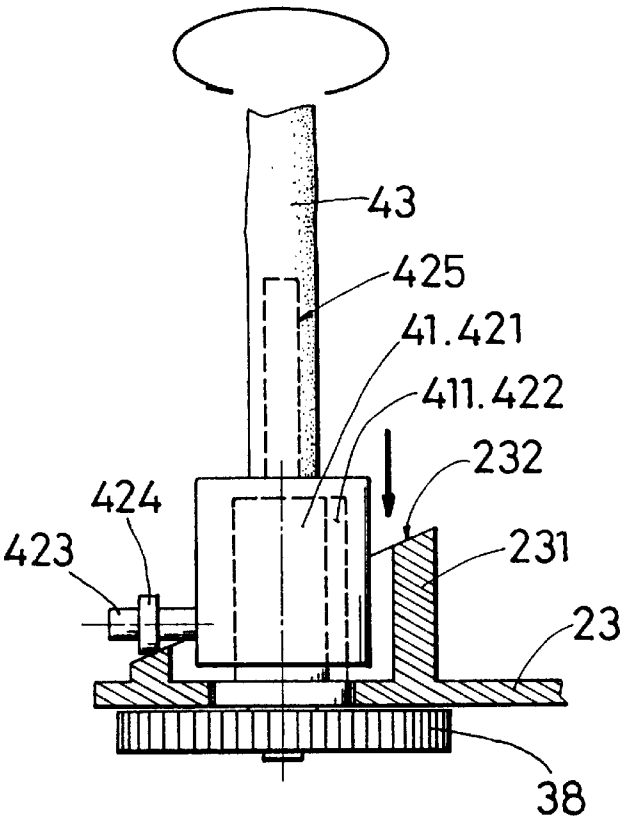
FIG. 6 is another vertical sectional view similar to FIG. 5 but showing the manner in which the toy flower is lowered.
Figure 5:
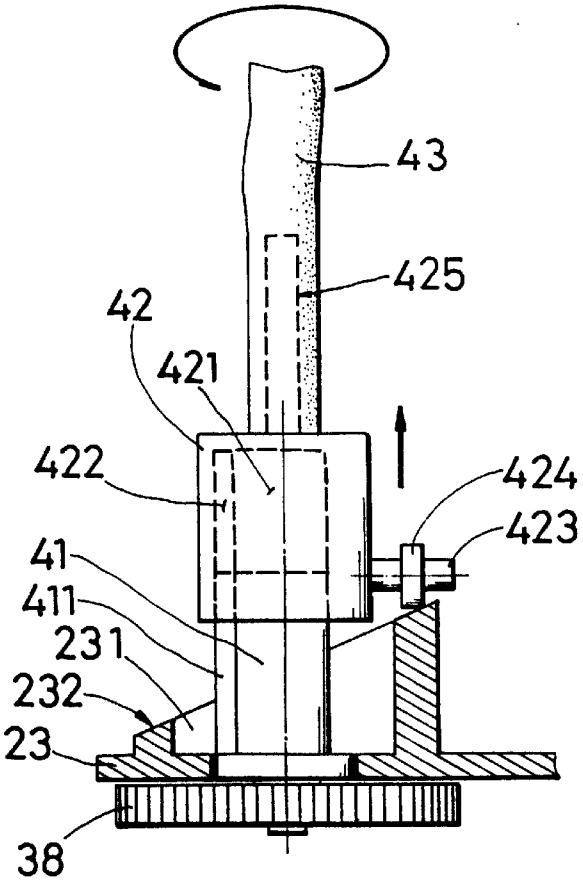
FIG. 5 is a vertical sectional view taken on line C—C of FIG. 4 showing the manner in which a toy flower is elevated.

Please now refer to FIGS. 2 and 3 at the same time. The transmission mechanism 3 includes a plurality of transmission gears that are located below the gear mounting board 23 and a motor 31 that is mounted on the gear mounting board 23 with a lower part, including a central shaft thereof, downward extending through the gear mounting board 23. The central shaft of the motor 31 is provided at a lower end with a driving wheel 311 that causes a driven wheel 33 included in the transmission mechanism 3 to rotate with it by means of a driving belt 32 surrounding the driving and the driven wheels 311 and 33, respectively. There is a first gear 331 coaxial with the driven wheel 33 and rotating along with the driven wheel 33. As can be clearly seen from FIG. 3, there are a second, a third, a fourth, and a fifth gears 34, 35, 36 and 37 sequentially meshing with one another while the second gear 34 meshes with the first gear 331. As a result, when the first gear 331 rotates, it brings the second, the third, the fourth, and the fifth gears 34, 35, 36, and 37 to rotate at the same time. The fourth and the fifth gears 36 and 37 respectively mesh with some (two are shown in FIG. 3) actuating gears 38 and therefore cause them to rotate at the same time. The actuating gear 38 each has a central actuating shaft 381 that is coaxial with a center of one of the cylinders 231 above the gear mounting board 23.

Please refer to FIGS. 2, 4, 5, and 6 at the same time. The more than one rotating mechanism 4 is mounted above the gear mounting board 23 and each corresponds to an actuating gear 38 below it. Each rotating mechanism 4 mainly includes a rotational shaft 41, an elevating cylinder 42, and a flower stem 43. The rotational shaft 41 is centered in the hollow cylinder 231 corresponding to the actuating gear 38 to connect to the actuating shaft 381 of the actuating gear 38 and rotates along with the corresponding actuating gear 38. A longitudinally extended long rib 411 is formed on an outer surface of the rotational shaft 41 (see FIG. 5). The elevating cylinder 42 is a hollow housing defining a shaft hole 421 corresponding to a contour of the rotational shaft 41 for the elevating cylinder 42 to fitly fix around the rotational shaft 41. There is a longitudinal long slot 422 formed on the elevating cylinder 42 corresponding to the long rib 411 for the same to engage with and project into the long slot 422, so that the elevating cylinder 42 associates with and rotates along with the rotational shaft 41. A lever 423 horizontally and outward extends from the outer surface of the elevating cylinder 42 and has a wheel 424 rotatably fixed around a predetermined position on the lever 423, and a flower stem support 425 upward extends from a top surface of the elevating cylinder 42. The flower stem 43 has an upper end in the form of a toy flower 431 (see FIG. 1) and a lower end downward extending through the through hole 211 on the top cover 21 corresponding to the hollow cylinder 231 and associated with the upward extended flower stem supports 425.

When the motor 31 of the transmission mechanism 3 is powered by the batteries in the battery compartment 12, the driving wheel 311 rotates along with the central shaft of the motor 31 and causes the driven wheel 33 to rotate by means of the driving belt 32. The driven wheel 33 further causes the first, the second, the third, the fourth, and the fifth gears 331, 34, 35, 36, and 37 to rotate, and the fourth and the fifth gears 36 and 37 further cause the actuating gears 38 to rotate at the same time. And, the central actuating shaft 381 of each actuating gear 38 further causes a corresponding rotational shaft 41 of the rotating mechanism 4 to rotate. When the rotational shafts 41 rotate, they bring the elevating cylinders 42 associated with them to rotate at the same time. At this point, the wheels 424 fitted around the levers 423 horizontally projected from the elevating cylinders 42 rotatably move along the inclined annular top surfaces 232 of the hollow cylinders 231 and cause the elevating cylinders 42 to ascend or descend relative to the rotational shafts 41. Accordingly, the flower stems 43 and the toy flowers 431 connected to the flower stem supports 425 on the tops of the elevating cylinders 42 are caused to move up and down while rotating, making the whole toy flowerpot more interesting and attractive.

Following are some of the advantages of the toy flowerpot of the present invention:

A. The toy flowerpot has flowers that move up and down while they turn and swing, and is therefore more interesting than the conventional toy flowerpot having flowers that can only rotate in uniform and monotonous movement.

B. The hollow cylinders 231 in the toy flowerpot of the present invention may have differently inclined annular top surfaces 232 that allow the toy flowers 431 connected to the elevating cylinders 42 to ascend or descend at different time while rotating and swinging.

C. The toy flowerpot of the present invention has novel but simple structure and can be easily assembled from the components thereof. The manufacture cost of the toy flowerpot of the present invention can therefore be reduced.

What is to be noted is the present invention described above is to be taken as a preferred embodiment of the invention and that various changes in the arrangements may be resorted to without departing from the spirit of the invention or the scope of the subjoined claims.

What is claimed is:

1. A toy flowerpot with movable toy flowers, comprising a pot, a fixing framework, a transmission mechanism, and more than one rotating mechanism;

said pot being a hollow member having an upper opening wider than a bottom thereof and being provided on an inner wall surface with a plurality of equally spaced and vertically extended supporting ribs and at the bottom with a battery compartment for accommodating batteries to power said transmission mechanism;

said fixing framework including a horizontal top cover that is supported on said supporting ribs, a plurality of connecting rods vertically downward extended from a bottom surface of said top cover, and a gear mounting board that is connected to lower ends of said connecting rods to locate below and in parallel with said top cover, said top cover being provided at proper positions with more than one through hole 211 that each has a toy flower stem extended therethrough, said gear mounting board being provided on a top surface with more than one hollow cylinder corresponding to said more than one through hole on said top cover, and each of said more than one hollow cylinder having a top end that defines an inclined annular top surface;

said transmission mechanism including a plurality of transmission gears that are located below said gear mounting board and a motor that is mounted on said gear mounting board with a lower part, including a central shaft thereof, downward extending through said gear mounting board, said central shaft of said motor being provided at a lower end with a driving wheel that causes a driven wheel to rotate with it by means of a driving belt surrounding said driving and said driven wheels, a first gear being coaxial with and rotating along with said driven wheel, a second, a third, a fourth, and a fifth gears sequentially meshing with one another while said second gear meshing with said first gear, such that when said first gear rotates, said second, said third, said fourth, and said fifth gears all rotate at the same time, said fourth and said fifth gears respectively meshing with more than one actuating gear and therefore causing said more than one actuating gear to rotate at the same time, and said more than one actuating gear each having a central actuating shaft that is coaxial with a center of one of said hollow cylinders above said gear mounting board;

said more than one rotating mechanism 4 each corresponding to one said actuating gear and one said hollow cylinder and mainly including a rotational shaft, an elevating cylinder, and a flower stem; said rotational shaft being formed on an outer surface with a longitudinally extended long rib and rotating along with said actuating shaft of said corresponding actuating gear; said elevating cylinder being a hollow housing defining a shaft hole corresponding to a contour of said rotational shaft for said elevating cylinder to fitly fix around said rotational shaft, a longitudinal long slot being formed on said elevating cylinder corresponding to said long rib for the latter to engage with and project into said long slot so that said elevating cylinder associates with and rotates along with said rotational shaft, a lever horizontally and outward extending from the outer surface of said elevating cylinder and having a wheel rotatably fixed around a predetermined position on said lever to move along said inclined annular top surface of said hollow cylinder, and a flower stem support upward extended from a top surface of said elevating cylinder; and said flower stem having an upper end forming a toy flower and a lower end downward extended through one said through hole on said top cover to associate with said flower stem support;

whereby when said motor in said transmission mechanism is powered by said batteries, all said transmission gears rotate to cause said elevating cylinders to rotate along with said rotational shafts of said more than one rotating mechanism while ascending or descending along said inclined annular top surfaces of said cylinders of said fixing framework, bringing said toy flowers at the upper ends of said flower stems associated with said elevating cylinders to rotate and ascend or descend at the same time.

2. A toy flowerpot with movable toy flowers as claimed in claim 1, wherein said toy flowers at the upper ends of said flower stems may be of any shape and be decorated with leaves.

* * * * *